United States Patent [19]

Kuno et al.

[11] 4,388,666

[45] Jun. 14, 1983

[54] DEMAGNETIZER FOR USE IN VEHICLES

[75] Inventors: Akira Kuno, Oobu; Muneaki Matsumoto, Okazaki; Koji Numata, Toyokawa, all of Japan

[73] Assignee: Nippon Soken, Inc., Nishio, Japan

[21] Appl. No.: 267,426

[22] Filed: May 26, 1981

[30] Foreign Application Priority Data

May 28, 1980 [JP] Japan ..... 55-71946

[51] Int. Cl.[3] ..... H01F 13/00

[52] U.S. Cl. ..... 361/149

[58] Field of Search ..... 361/149

[56] References Cited

U.S. PATENT DOCUMENTS 3,110,282 11/1963 Foerster ..... 361/149

FOREIGN PATENT DOCUMENTS 619212 3/1949 United Kingdom ..... 361/149

OTHER PUBLICATIONS

"Combating Magnetic Mines", *Electrical Review*, Sep. 21, 1945, p. 412.

*Primary Examiner*—G. Z. Rubinson
*Assistant Examiner*—L. C. Schroeder
*Attorney, Agent, or Firm*—Cushman, Darby & Cushman

[57] ABSTRACT

A demagnetizer for removing residual magnetism in vehicles includes a single coil which is adapted to surround a portion or the whole of the body of a vehicle. A direct current and alternating current are supplied to the single coil simultaneously to produce a d.c. magnetic field and an a.c. magnetic field. The direction and magnitude of the d.c. magnetic field are so arranged, that the d.c. magnetic field cancels the external magnetic field. The magnitude of the a.c. magnetic field is varied within a predetermined range periodically to remove the residual magnetism.

1 Claim, 4 Drawing Figures

DEMAGNETIZER FOR USE IN VEHICLES

BACKGROUND OF THE INVENTION

This invention relates to a demagnetizer for use in vehicles for removing residual magnetism in a relevant part of the vehicle.

Hitherto, in order to ensure correct bearing indication of a bearing indicator for automobiles, the magnetic field distortion due to residual magnetism in the vehicle or the like has been compensated for by externally mounted compensation magnets. There has been no device for removing by demagnetizing the vehicle.

In such a conventional construction, various considerations such as the position of installation, number and magnetic field intensity of compensation magnets to be externally installed for cancelling the field distortion due to the residual magnetism in the vehicle are necessary and present various complications for effecting the compensation. In addition, different compensations are required with different vehicles since the field distortion characteristics varies with vehicles.

SUMMARY OF THE INVENTION

The invention is contemplated in the light of the above problems, and it has an object of providing a demagnetizer for use in vehicles, with which both a direct current magnetic field and an alternating current magnetic field are set up by simultaneously supplying direct current and alternating current to a magnetic field generation coil wound to surround the relevant part of the vehicle to cancel the external magnetic field with the afore-mentioned direct current magnetic field so as to produce an imaginary magnetism-free space and demagnetize the relevant part in the imaginary magnetism-free space with the afore-mentioned alternating current magnetic field, thus reliably removing the magnetic field distortion due to the residual magnetism in the relevant part of the vehicle.

Figure 1:
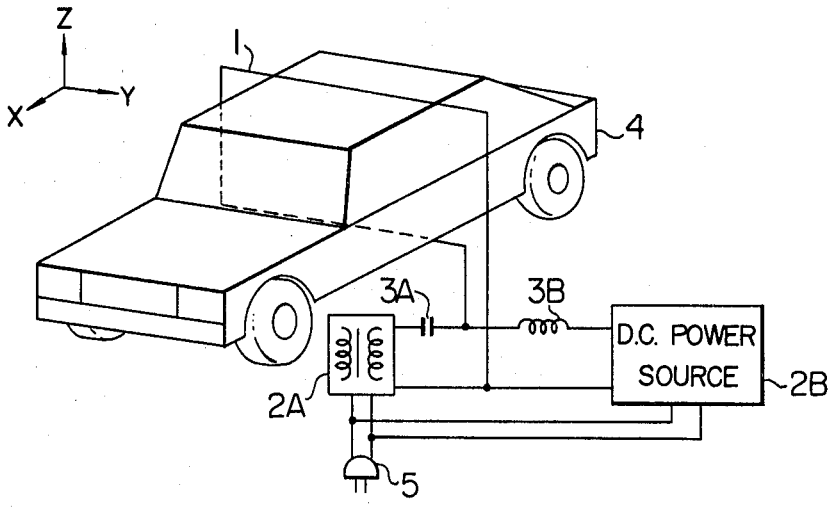
FIG. 1 is a pictorial view partly in schematic showing an embodiment of the invention.
Figure 2A:
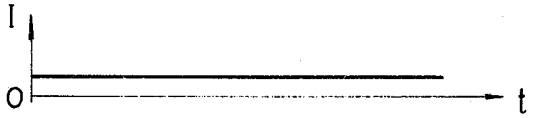
Figure 2B:
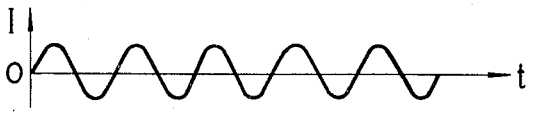
Figure 2C:
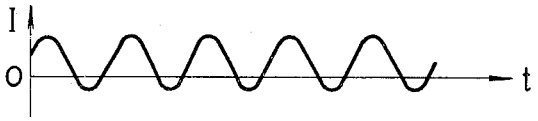

FIGS. *2a* to *2c* are views showing waveforms of currents flowing through various parts of the circuit shown in FIG. 1.

DESCRIPTION OF THE PREFERRED EMBODIMENTS

Now, the invention will be described in conjunction with a preferred embodiment thereof with reference to the accompanying drawings. FIG. 1 is a view schematically showing the method of demagnetizing the relevant part of a vehicle. Designated at 1 is a magnetic field coil which surrounds a vehicle 4 and which is connected at one end through a direct current blocking capacitor 3A to a transformer 2A and also through an alternating current blocking inductor 3B to a direct current power source 2B, and desired levels of alternating current and direct current can be obtained. A power source plug 5 is for connection to a commercially available alternating current power source. The transformer 2A, direct current power source 2B, direct current blocking capacitor 3A and alternating current blocking inductor 3B from a composite current generator. The direction of the coil 1 is so arranged that the direction of a direct current magnetic field is opposite to the direction of the external magnetic field, that is, the terrestrial magnetism.

FIGS. *2a* to *2c* show waveforms of currents flowing through various parts of the circuit shown in FIG. 1. More particularly, a direct current shown in FIG. *2a* flows from the direct current power source 2B, an alternating current shown in FIG. *2b* flows from the transformer 2A, and these currents are superimposed upon each other to produce a composite current shown in FIG. *2c* which flows through the magnetic field coil 1. The direct current magnetic field set up by the direct current cancels the external magnetic field, and the alternating current magnetic field set up by the alternating current is gradually attenuated to remove the magnetic field distortion in the vehicle 4. In this case, the magnetic field distortion can be reliably removed since the alternating current magnetic field is provided in the state where the external magnetic field is cancelled. As the direct current magnetic field for cancelling the external magnetic field such as terrestrial magnetism, a magnetic flux density of 0.2 to 0.4 gauss (e.g. in Japan) is necessary. In the case of a heavy weight vehicle of 1.5-ton class, an alternating current magnetic field of a magnetic density of about 10 gauss maximum is necessary. In this case, the alternating current magnetic field is intensified so that the magnetic flux density increases from 0 to about 10 gauss during a time period of about 30 seconds and then it is weakened gradually to decrease the magnetic flux density to 0 gauss during a time period of about 1 to −2 minutes. For this reason, sufficient direct current (FIG. *2a*) and alternating current (FIG. *2b*) to obtain the flux density of the afore-mentioned values are supplied to the magnetic field coil 1.

While in the above embodiment the current shown in FIG. *2c* is caused to flow through the magnetic field coil 1 by using the transformer 2A, direct current blocking capacitor 3A, direct current power generator 2B and alternating current blocking inductor 3B, it is also possible to control a direct current power source, which can cause positive and negative current, for causing the current shown in FIG. *2c*. Further, the alternating current may be at frequencies other than the commercial frequencies as well, and also it need not be sinusoidal but may also be rectangular in waveform. Further, while in the above embodiment the demagnetization is effected only in the X-axis direction, it is also possible to effect demagnetization in all the X-, Y- and Z-axes by permitting the magnetic field coil 1 to be directed to the Y- and Z-axis directions as well.

Furthermore, a width of the coil 1 in the X-axis direction may be suitably selected to obtain a narrower or wider area of magnetic fields.

As has been described in the foregoing, according to the invention a magnetic field coil wound to surround the relevant part of a vehicle and a current generator for simultaneously supplying direct current and alternating current to the magnetic field coil are provided for simultaneously setting up a direct current magnetic field and alternating current magnetic field with the aforementioned direct current and alternating current caused to pass through the magnetic field coil to cancel the external magnetic field with the direct current magnetic field set up so as to form an imaginary magnetism-free space and demagnetize the relevant part of the vehicle in the imaginary magnetism-free space with the alternating current magnetic field. Thus, an excellent effect of reliably removing the magnetic field distortion due to the residual magnetism in the relevant part of the vehicle can be obtained by appropriately using a single magnetic field coil.

We claim:

1. A demagnetizer for removing residual magnetism in a vehicle comprising:

a magnetic field coil adapted to surround a portion of said vehicle from which the residual magnetism is to be removed, said magnetic coil having first and second input terminals, a series circuit of an alternating current blocking inductor and a direct current source connected between said first and second input terminals of said magnetic field coil for supplying thereto a direct current, a series circuit of a direct current blocking capacitor and an alternating current source connected between said first and second input terminals of said magnetic field coil for supplying thereto an alternating current simultaneously with said direct current, said magnetic field coil producing a direct current magnetic field and an alternating current magnetic field simultaneously, said direct current magnetic field being opposite in direction to cancel the external magnetic field, said alternating current magnetic field being effective to remove the residual magnetism in said portion of said vehicle.

* * * * *